United States Patent [19]

Wenzel et al.

[11] Patent Number: 4,776,332

[45] Date of Patent: Oct. 11, 1988

[54] DEEP SUBMERGENCE RESPIRATOR OUTFIT

[75] Inventors: Jürgen Wenzel, Cologne; Peter Hampe, St. Augustin; Norbert Luks, Siegburg; Hartmut Friedrich; Harry Hebborn, both of Cologne, all of Fed. Rep. of Germany

[73] Assignee: Deutsche Forschnugs- und Versuchsanstalt fur Luft- und Raumfahrt E.V., Fed. Rep. of Germany

[21] Appl. No.: 74,368

[22] Filed: Jul. 16, 1987

[30] Foreign Application Priority Data

Jul. 24, 1986 [DE] Fed. Rep. of Germany ..... 3625016

[51] Int. Cl.[4] ..... B63C 11/22

[52] U.S. Cl. ..... 128/201.27; 128/204.29

[58] Field of Search ..... 128/201.27, 204.29

[56] References Cited

U.S. PATENT DOCUMENTS

| | | | |
|---|---|---|---|
| 3,370,585 | 2/1968 | O'Neill . | |
| 3,859,994 | 1/1975 | Almqvist et al. | 128/201.27 |
| 4,137,912 | 2/1979 | O'Neill | 128/204.29 |
| 4,362,154 | 12/1982 | Le Masson | 128/201.27 X |

OTHER PUBLICATIONS

German Publication, "Tauchtechnik", pp. 109–111 (Apr. 1969).

*Primary Examiner*—Gerald A. Michalsky

*Attorney, Agent, or Firm*—Spensley Horn Jubas & Lubitz

[57] ABSTRACT

Intermediate a first pressure reducing means (12, 15) reducing the pressure of a pressure source (10) to nearly the external pressure $P_A$ of the diving depth, and the respiratory mask (18) of the diver, there is a flexible first buffer container (16) whose internal pressure is slightly above the external pressure to ensure that a buffer volume of respiration gas is continuously available directly to the diver. A second buffer container (21) is mounted intermediate the respiratory mask (18) and a second pressure reducing means (26, 23) for waste air. The pressure maintained in the second buffer container is slightly below the external pressure $P_A$ so that a specific exhalation volume is permanently available to the diver. To avoid a direct blowing through the respiratory mask, a relief pressure valve (20) only opens responsive to the lung activity of the diver.

5 Claims, 1 Drawing Sheet

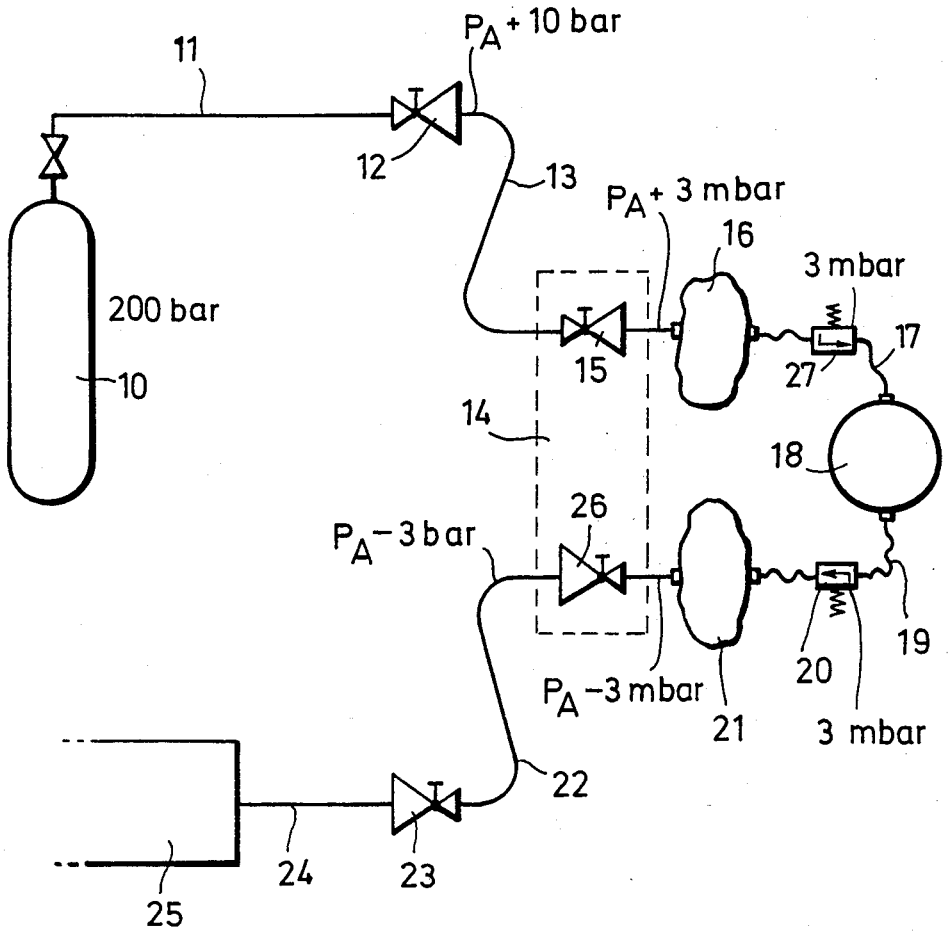
11
$P_A$ + 10 bar
12
13
$P_A$ + 3 mbar
16
3 mbar
200 bar
10
15
27
17
14
18
26
$P_A$ − 3 bar
19
20
$P_A$ −3 mbar
21
3 mbar
22
24
23
25

DEEP SUBMERGENCE RESPIRATOR OUTFIT

The invention relates to a deep submergence respirator outfit.

In regions of an excessive gas density, e.g. in case of heliox diving into areas below 350 m, a suddenly rising respiratory resistance may be experienced with conventional deep submergence systems at critical points such as valves, connecting pieces and changed cross sections, even if gas flows are moderately above the respiration at rest. Said increased respiratory resistance is due to turbulent flow conditions which have not yet been investigated sufficiently, the basis residing in the extreme physiologic band width of the first and second time-dependent lung-volume derivation $$(dv/dt), (d^2v/dt^2)$$

wherein v refers to the lung volume and t to the time. Due to the occurring turbulences, the diver is temporarily provided insufficiently with respiration gas or the discharge of the exhaled gases is inhibited. To overcome such difficulties which are experienced in lower diving depths, it is customary to bore open the conventional apparatuses in order to obtain larger cross sections of the conduits and a higher gas throughput accordingly. However, as a result thereof, one has to put up with high-volume designs and thick conduits. On the other hand, even in case of large flow cross sections, a critical limit value is reached very soon again for the reappearance of the mentioned difficulties. In the book "Tauchtechnik" (Diving Technics), Vol. I, pages 109–111, Springer Verlag Berlin/Heidelberg 1969, there is disclosed a mixed gas-floating diving apparatus comprising, upstream and downstream of the respiration mask in the respiration gas path, a flexible respiratory bag, the respiration gas being supplied via a pressure reducer valve and a plurality of dosing nozzles to the inhalation bag to flow to the respiration mask and from there to the exhalation bag. From the latter, one gas path extends via a higher pressure valve to the environment while another gas path extends to a $CO_2$ absorption tank for binding the $CO_2$ contained in the exhaled air. The residual oxygen contained in the exhaled air is supplied to the inhalation bag. In case of the known device, respiration gas flows continuously through the respiratory mask. This is not a demand system in which the respiration gas supply depends upon the oxygen consumption of the diver. The inhalation air bag serves as a mixing chamber to mix fresh respiration gas with oxygen from the $CO_2$ absorption tank, while the exhalation bag being under a certain constant internal pressure serves as an ante-chamber for the high-pressure valve extending into the environment. While the diver does not breathe, respiration gas is flowing through the system to be evacuated to the outside. It is unfavorable in a respiratory system of this type that, while respiration gas consumption is high, a high amount thereof is discharged unused into the environment. The exhalation and the inhalation bags being in fluid communication and their internal pressures being substantially equal accordingly, both bags are in the same inflated condition. However, it is not easier for the diver to inhale or exhale air; on the contrary, as it becomes easier for him to inhale air, it becomes more difficult to exhale it. The diving equipment is suitable but only for diving as deep as 200 m at most.

It is an object of the invention to provide a deep submergence respirator set by which it is ensured that the required respiration gas amount is always available to the diver whose exhalation is not inhibited either.

According to the invention, a sufficiently big and flexible buffer volume is made available by at least one resilient buffer container kept at the level of respiration pressure, thus enabling the inhaling or exhaling diver not to depend on the fact that the required gas amount, in the form of a flowing column, immediately moves on or is evacuated during exhalation. The respiration conditions which may be ensured by the buffer volumina substantially correspond to natural respiration so that physiological peak values are converted into permanent capacities which are well controllable technically.

The deep submergence respirator outfit is a demand system supplying respiration gas to the diver's mask only in case of inhalation and discharging said gas from the diver's mask only in case of exhalation. Due to the considerable increase of the Reynolds number under high pressure in case of very low diving depths, the lung apparatus of the known demand systems has to be provided with valves of a large cross section. The use of the flexible buffer containers permits to provide smaller valves without a sacrifice of the respiratory comfort of the diver.

The deep submergence respirator outfit of the invention is particularly well suited for diving in depths below 350 m, while the diver's body is exposed to environmental pressure. Further, the respiratory set may be employed in an emergency respiration system of a pressure chamber. In case of the saturation submergence technics, divers are prepared physiologically for the diving pressure conditions in a pressure container above water in which pressure is built up corresponding to the diving depth. If the atmosphere in such a pressure container is poisoned (accidentally), a quick transport of persons to the outside is not possible. Under such circumstances, use is to be made of emergency respirators enabling such persons to remain in the pressure chamber and ensuring the required respiratory gas supply by means of a respiratory mask. Moreover, the invention is applicable for emergency respirators in diving systems such as diving bells.

In case of two buffer containers of which one is mounted in the supply line of the respiratory mask while the other is provided in its discharge line, a slight overpressure with respect to the external pressure is maintained in the first buffer container, while the pressure in the second buffer container is slightly inferior to the external pressure so that, due to a collapse of the second container, sufficient volume is available for the receipt of respiration gases. To avoid a blowing of the respiration gases from the first buffer container through the respiratory mask into the second buffer container, a high pressure relief valve means appropriately mounted between the first and second buffer containers does not open before the pressure in the respiratory mask is higher than the sum of both differential pressures. As long as the diver does not breathe, said highpressure relief valve means blocks the respiration gas path through the respiratory mask, and it opens upon the diver's inhalation or exhalation.

With reference to the sole FIGURE of the drawing, one embodiment of the invention will be explained hereunder in more detail.

The drawing is a schematic illustration of the system of the deep submergence respirator oufit.

In a reservoir 10, the respiration gas such as heliox, being a mixture of helium and oxygen, is under a pressure which is higher than the pressure corresponding to the maximum diving depth, said pressure in reservoir 10 being for instance 200 bar. From reservoir 10, a rigid pipe line 11 extends to a pressure reducing valve 12 reducing the gas pressure to a pressure of $p_A+10$ bar, $p_A$ being the external pressure corresponding to the diving depth. From the pressure reducing valve 12, a pipe or hose line 13 extends to the lung apparatus 14 taken along by the diver and containing another pressure reducing valve 15 reducing the gas pressure of $p_A+10$ bar to a pressure of a few mbar above the external pressure $p_A$, i.e. to $p_A+3$ mbar in the instant case. The output of the pressure reducing valve 15 is connected to the first buffer container 16 being joined to the inhalation hose 17 of the respiratory mask 18. The inhalation hose 17 contains a high pressure valve 27. The exhalation hose 19 of the respiratory mask 18 is connected through a high pressure valve 20 to the second buffer container 21 which, by itself, via a pressure reducing valve 26 contained in the lung apparatus 14, and via a pipe line 22, is connected to the waste air controller 23 from which a hose or pipe line 24 extends to the collecting vessel 25 or into the atmosphere, the respiratory mask 18 being positioned in series with the inhalation hose 17 and the exhalation hose 19. The two buffer containers 16 and 21 are flexible bags exposed to the external pressure $p_A$ adapted to collapse under the action of the latter. In a preferred embodiment of the invention each buffer container 16 and 21 has a volume of at least 1 liter.

The pressure reducing valve 15 supplies respiration gas to the first buffer container 16 at a pressure of 3 mbar above the external pressure $p_A$ thus permitting to always maintain a slight excess pressure in the buffer container 16 which is kept in filled condition. As a result, sufficient respiration gas is always available to the diver even in case of his quick breathing. Due to the pressure reducing valve 26, the pressure maintained in the second buffer container 21 is slightly below the ambient pressure which, in the present case, is $p_A$ minus-3 m bar. Thus, the second buffer container 21 is normally empty to collapse and to offer the buffer volume required for exhalation. The output-side pressure of the pressure reducing valve 26 is lower by about 3 bar than the input-side pressure. Due to the pressure reducing valves 26 and 23, the exhalation gases are decompressed in two steps to the atmospheric pressure. Pressure reducing valves 15 and 26 accomodated in the lung apparatus 14 are pressure regulators, the output pressure of valve 15 and the input pressure of valve 26 being controlled responsive to the external pressure $p_A$ as explained above.

Due to the relief pressure valves 27 and 20, respiration gas is prevented from flowing out of the buffer container 16 through the respiratory mask 18 directly into buffer container 21 by avoiding the diver's respiration system. The pressure to which the relief pressure valve 20 is responsive for opening is at least equal to the pressure difference between external pressure $p_A$ and the pressure at the inlet of the pressure reducing valve 26. The sum of the responsive pressures of the relief pressure valves 27 and 20 is at least equal to the pressure difference maintained between the pressure reducing valves 15 and 26 in the buffer containers 16 and 21, it is 6 mbar in the instant case. The responsive pressure of each of the pressure relief valves 27 and 20 of the instant embodiment is 3 mbar.

In place of two relief pressure valves 27 and 20, use may be made of one sole relief pressure valve 20 which has a responsive pressure of 6 mbar and which is arranged intermediate the respiratory mask 18 and buffer container 21. If the relief pressure valve means is divided into two relief valves 27 and 20 of which, with respect to the gas path, one is provided upstream of the respiratory mask and one downstream thereof, the respiration gas path is favorably interrupted when the user takes off his respiratory mask 18. This will happen, if the diver fitted with the deep diving equipment will enter a pressure chamber where respiratory gas is pressurized. Such pressure chambers are used for the slow decompression of the diver and there, he may take off the respiratory mask 18, but no respiratory gas will escape from the reservoir 10 into the pressure chamber atmosphere.

What is claimed is:

1. A deep submergence respirator system comprising:

a respiratory mask in communication with a gas supply line and a gas discharge line, a first compressible buffer container in communication with the gas supply line, a second compressible buffer container in communication with the gas discharge line, a first valve in communication with the gas supply line for maintaining the pressure inside the first buffer container at a level above the pressure outside the first buffer container, a second valve in communication with the gas discharge line for maintaining the pressure inside the second buffer container at a level below the pressure outside the second buffer container, thereby establishing a difference in internal pressure between the first and second buffer containers, a relief pressure valve provided between the first buffer container and the second buffer container, means for opening the relief pressure valve when the pressure in the respiratory mask is higher than the difference in internal pressure between the first and second buffer containers, whereby gas is supplied through the gas supply line to the respiratory mask upon inhalation and gas is discharge from the respiratory mask through the gas discharge line upon exhalation.

2. A deep submergence respirator outfit according to claim 1 wherein the relief pressure valve comprises a first relief pressure valve provided between the first buffer container and the respiratory mask, the first relief pressure valve opening at a first responsive pressure, a second relief pressure valve provided between the second buffer container and the respiratory mask, the second relief pressure valve opening at a second responsive pressure, the sum of the first and second responsive pressures being equal to the difference in internal pressure between the first and second buffer containers.

3. A deep submergence respirator outfit according to claim 1, wherein the difference in internal pressure between the first and second buffer containers is less than 20 mbar.

4. A deep submergence respirator outfit according to claim 1, wherein the difference in internal pressure between the first and second buffer containers is less than 5 mbar.

5. A deep submergence respirator outfit according to claim 1, wherein the first buffer container and the second buffer container each has a volume of at least 1 liter.

* * * * *